United States Patent [19]

Popplewell, Jr. et al.

[11] 4,069,941

[45] Jan. 24, 1978

[54] ENGAGEABLE CARD RACKS

[75] Inventors: William T. Popplewell, Jr., Prairie Village, Kans.; Timothy C. Driller, Kansas City, Mo.

[73] Assignee: Plastic Sales & Mfg. Co., Inc., Kansas City, Mo.

[21] Appl. No.: 773,824

[22] Filed: Mar. 3, 1977

[51] Int. Cl.[2] ..... A47F 7/00

[52] U.S. Cl. ..... 220/23.4; 206/215; 211/50; 211/126; 312/111

[58] Field of Search ..... 211/50, 126, 55, 56, 211/128; 206/215, 44 R; 220/23.4, 22; 312/111, 107, 234.1, 140.4; 108/60, 25; 52/581

[56] References Cited

U.S. PATENT DOCUMENTS

| | | | |
|---|---|---|---|
| 1,760,456 | 5/1930 | Palmenberg | 211/184 X |
| 2,283,301 | 5/1942 | Waddell | 312/107 X |

FOREIGN PATENT DOCUMENTS

| | | | |
|---|---|---|---|
| 480,228 | 12/1969 | Switzerland | 220/23.4 |

*Primary Examiner*—Roy D. Frazier
*Assistant Examiner*—Robert W. Gibson, Jr.
*Attorney, Agent, or Firm*—Fishburn, Gold & Litman

[57] ABSTRACT

The present invention pertains to a display rack, for greeting cards or the like, which comprises compartmented tray sections that are engaged in an edge-to-edge relationship to provide a card rack of desired width. More specifically, the assembled card rack comprises a first tray section having dividers therein for separating a plurality of compartments for cards, and a second tray section that includes a slotted, downwardly projecting flap that is emplaced in the first section. The dividers of the first section are inserted into the slots of the flap on the second section, and interlocking means can be included for preventing inadvertent disengagement of the assembled sections.

11 Claims, 6 Drawing Figures

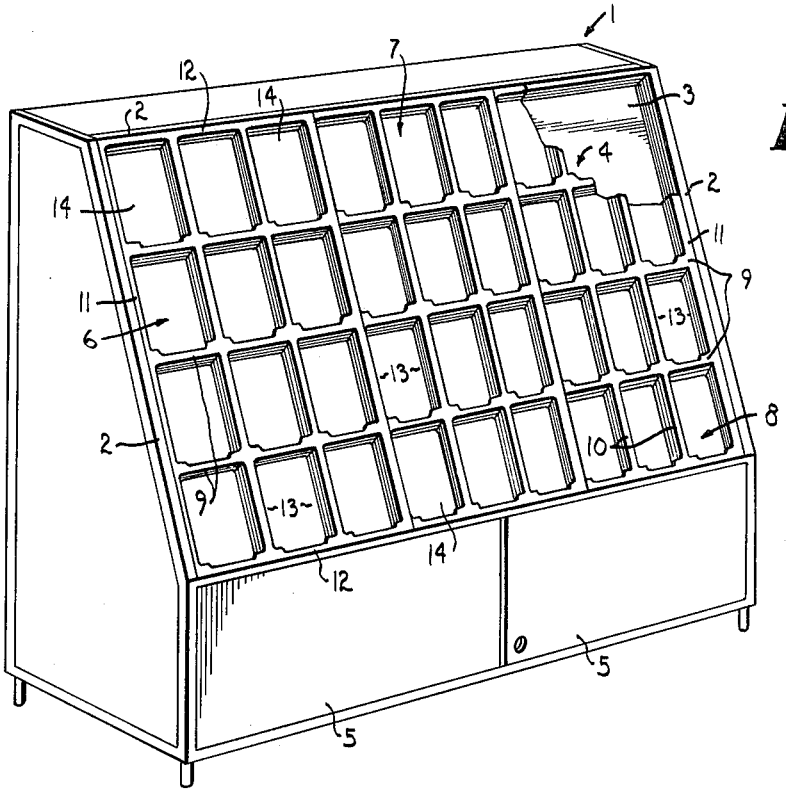
Fig. 1.
Fig. 2.
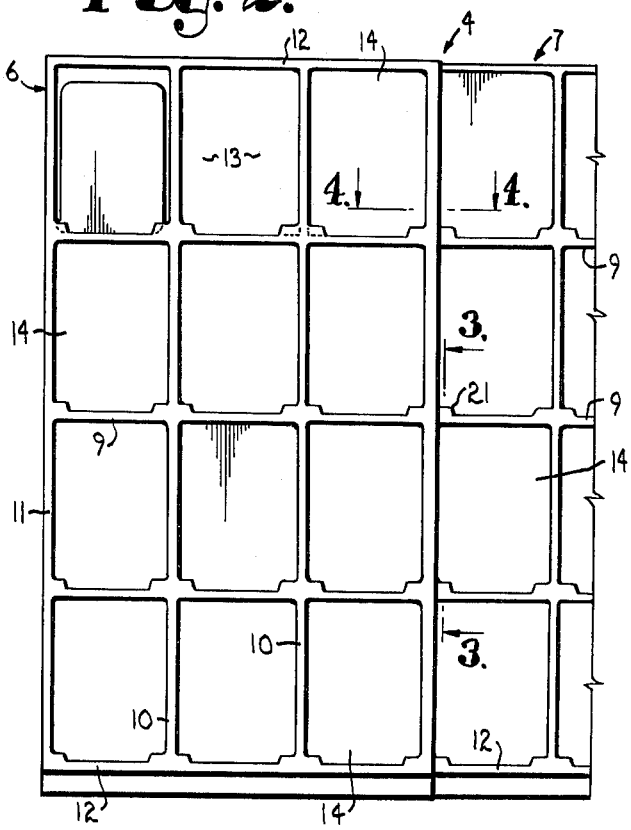
Fig. 3.
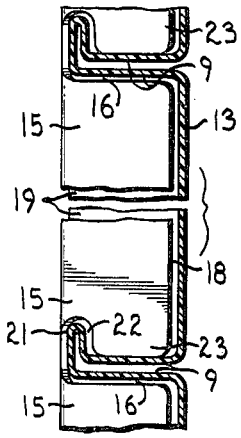
Fig. 4.
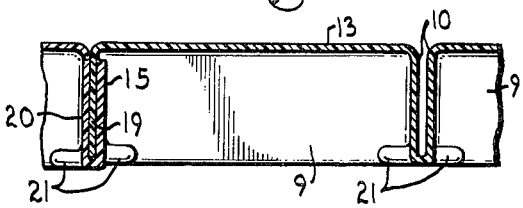

ENGAGEABLE CARD RACKS

BACKGROUND OF THE INVENTION

The present invention pertains to display racks for greeting cards or the like, and more particularly pertains to display racks that can be assembled at a retailing site by edge-to-edge engagement of two or more tray sections to provide a rack having a desired width. It is usually preferred that the width of such racks be sufficient to permit unimpeded display and customer access to a large variety of cards, yet the desired width of a rack is often impractically large and costly from the standpoint of constructing, packaging and shipping it all in one piece.

SUMMARY OF THE INVENTION

It is therefore an object of the present invention to provide an improved card rack that can be assembled at a card display site by engagement of two or more tray sections that have been shipped as individual pieces.

Another object is to provide an improved card rack comprising an assembly of two or more strong, lightweight tray sections.

Still another object is to provide a card rack in accordance with the previously-stated objects, and wherein the tray sections are interlockable to prevent inadvertent disengagement following the assembly thereof to form a card rack. Yet another object is to provide an improved card rack assembled from tray sections that have been molded from a flexible, resilient plastic material.

Other objects and advantages of the invention will become apparent from the following description, the drawings, and the appended claims.

The present card rack comprises at least two tray sections that have been assembled edge to edge, and includes a first tray section with spaced dividers therein that separate compartments of the tray, and a second tray section having an attached flap along one edge thereof, with engagement of the two sections being accomplished by emplacement of the flap of the second section within the first section. The flap includes a plurality of slots located at spaced intervals along its length, and the spacing of the slot intervals corresponds to the spacing of the dividers in the first section. When the flap is emplaced in the second section, the dividers therein become inserted in the slots of the flap, thus effecting engagement of the two sections while permitting height and depth alignment thereof. To advantage, the first tray section can have an upstanding edge member which abuts the downwardly projecting flap of the second section, and interlocking means can be provided for preventing inadvertent disengagement of the tray sections following the assembly thereof to form a tray having a desired width.

BRIEF DESCRIPTION OF THE DRAWINGS

FIG. 1 is a perspective view of a cabinet having a card rack thereon that is constructed in accordance with the present invention.

FIG. 2 is a fragmented elevational view of an assembled card rack constructed in accordance with the present invention.

FIG. 3 is a fragmented sectional view of the card rack along line 3—3 in FIG. 2.

FIG. 4 is a fragmented sectional view of the card rack along line 4—4 of FIG. 2.

DESCRIPTION OF PREFERRED AND ALTERNATIVE EMBODIMENTS

Figure 5:
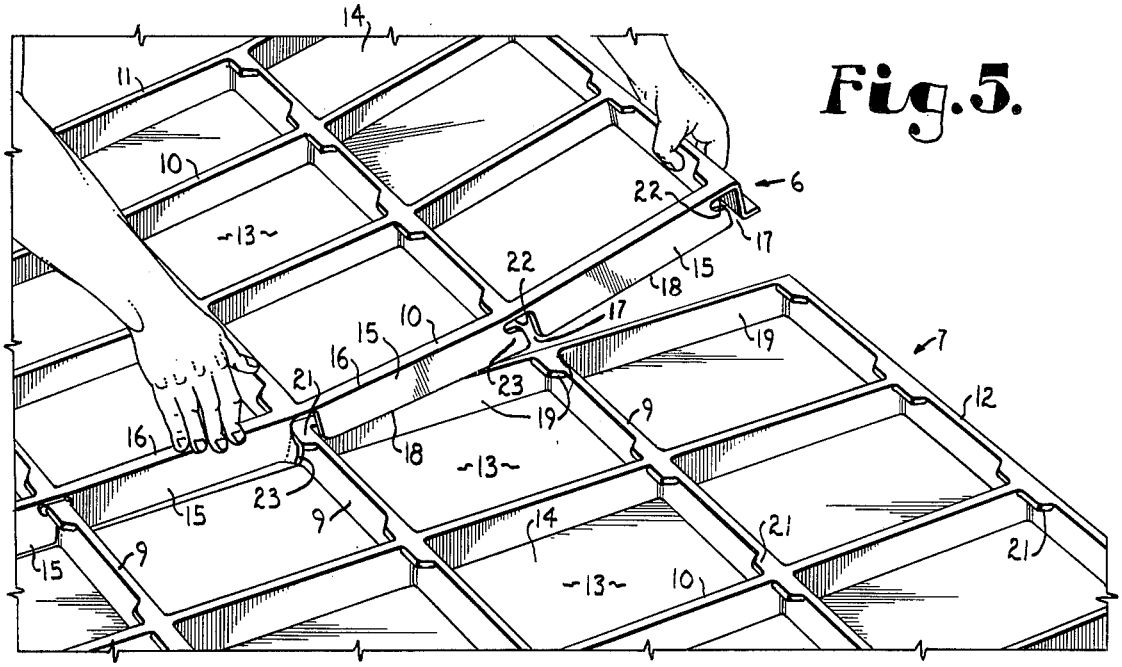
FIG. 5 is a partially fragmented perspective view illustrating insertion of a divider of one tray section into a slot in the flap on another section during assembly of the card rack.

In FIG. 1, a cabinet 1 comprises frame members 2 and a plate 3 which bound a recess into which a fully-assembled card rack 4 is inserted and thereby maintained in an upright position. The cabinet further comprises sliding doors 5 which cover access openings to storage space in the lower section of the cabinet. As shown in FIGS. 1 and 2, card rack 4 comprises three tray sections, 6, 7 and 8, having transversally intersecting dividers 9 and 10, outer frame members 11 and 12, and floors 13. The dividers, frame members and the floors bound compartments in the form of card pockets 14 wherein greeting cards or other articles are rested for display and made readily available to potential customers for examination prior to purchase.

Figure 6:
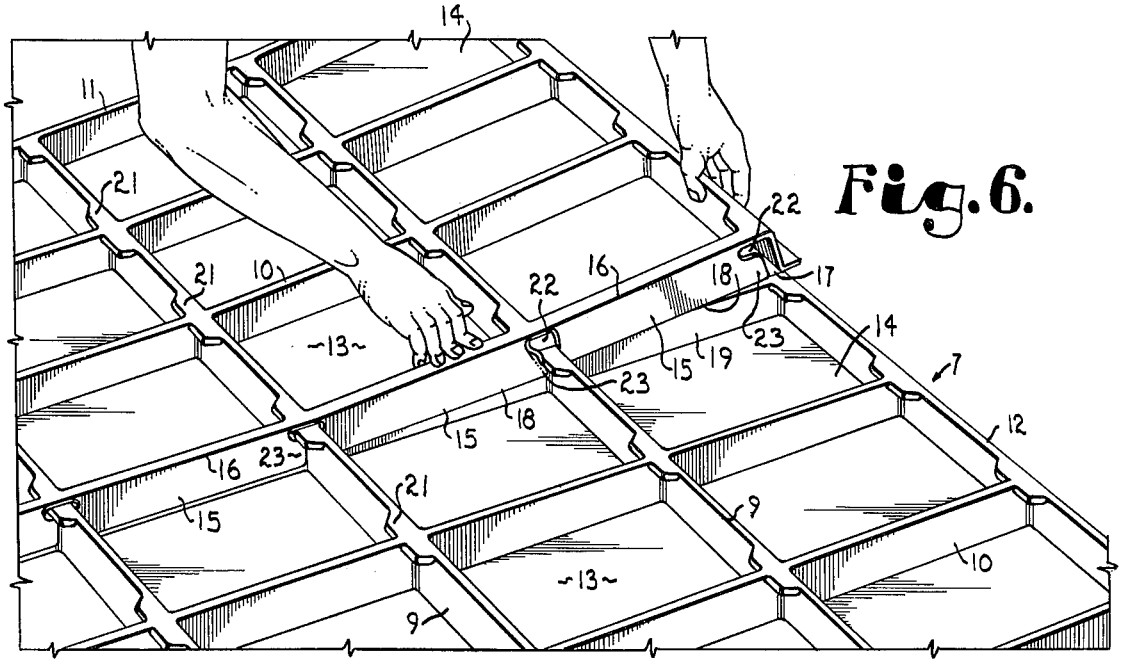
FIG. 6 is a partially fragmented perspective view akin to FIG. 5, but illustrates insertion of the next divider of the one tray section into the next slot in the flap of the other section during assembly of the card rack.

Referring to FIGS. 5 and 6, the card rack 4 comprises a tray section 7 which has elongated, spaced dividers 9 that separate the card pockets 14 of the section, and another tray section 6 having a downwardly projecting flap 15 attached along an edge 16 thereof. Flap 15 has a plurality of slots 17 at spaced intervals along its length, and the spacing of these intervals corresponds to the spacing between that of the dividers 9 in tray 7. Accordingly, when the flap 15 of tray section 6 is emplaced inside tray section 7 as shown in FIGS. 5 and 6, the dividers 9 of the tray become inserted in the slots 17 of the flap, thereby effecting engagement of the two sections and permitting height and depth alignment thereof.

As shown in the drawings, the flap 15 has a lower edge 18 from which slots 17 lead substantially vertically, and the lengthwise extension of the dividers 9 is oriented substantially perpendicular to the lengthwise extension of the flap. Accordingly, tray section 7 can include an upstanding edge member 19 that is interconnected perpendicularly with dividers 9 and against which flap 15 is abutted when emplaced in tray section 7. In addition, flap 15 can be a downwardly-projecting section of an outer vertical divider 10 that also has an adjoined section 20 (FIG. 4) running parallel and in spaced relation to the flap to provide a divider with a U-shaped cross section and a central space therein into which the upstanding edge member 19 can be inserted, thereby stabilizing the tray sections against lateral displacement that might cause their disengagement following the assembly thereof as shown in the drawings.

Interlocking means can also be provided as further assurance against inadvertent disengagement of dividers 9 from slots 16 in the flap 15 following assembly of the tray section to form a card rack of desired width. The slots and the dividers 9 can, for example, be provided with a wedge shape to effect interlocking by means of dovetailing engagement of the dividers with the slots. As shown in the drawings, the interlocking means for the tray sections comprises laterally-projecting lugs 21 on dividers 9 at the locus of interconnection of the dividers and upstanding edge member 19, and substantially horizontal deviations 22 in slots 16 which receive the lugs 21 when flap 15 is emplaced in tray section 7. Lugs 21 can also be located at intersections of the dividers 9 and 10 with each other, and with the outer frame members 11 and 12, to provide stiffening at these points and to serve as keepers for retaining cards or other articles within the pockets of the tray sections. In addition to lugs 21 and deviations 22 in slots 16 of the flap 15, the interlocking means for the tray sections can also comprise tab sections 23 which are adjacent to the slots and positioned beneath the lugs 22 when the flap 15 is engageably emplaced in tray 7. To facilitate lateral deformation of the tab sections so they will pass the lugs 21 during assembly of the card rack as shown in FIGS. 5 and 6, it is advantageous that the flap, including the tab sections, be made of a resilient material whereby the tabs are deformed laterally during passage over the lugs and then spring back to their normally undeformed condition for engagement of the lugs to effect interlocking of the tray sections.

As best illustrated in FIG. 4, the interconnection of the flap 15 and the edge member 19 forms a structural rib which extends along the joint, and provides additional strength and rigidity to the card rack 4.

Engagement of tray section 8 with section 7 can be accomplished by use of a slotted flap on section 8 in the same fashion that tray section 6 is engaged with section 7. Alternatively, tray section 7 can be provided with a flap for engagement with section 8 in the same fashion. Furthermore, even though assembly of 3 tray sections to form a card rack of desired width is shown and described, it will be understood that card racks of the present invention can be assembled from only two or more than three tray sections to provide a card rack of desired width. It will also be understood that even though the tray sections shown and described comprise vertically and horizontally extending dividers which transversally intersect each other and are spaced at regular intervals, some or all of the vertical dividers can be omitted, and the spacing between the dividers can be irregular when such is preferred.

Although the tray sections of the card rack can be made from any suitable material, flexible and resilient plastics are preferred, especially those that can be molded into thin but strong and lightweight tray sections. Acrylonitrile-butadiene-styrene (ABS) resin is a preferred plastic, but other plastics can be used when preferable and practical. By molding the tray sections from plastic, all component parts thereof such as floors 13, dividers 9 and 10, outer frame members 11 and 12, lugs 21, flap 15, and upstanding edge 19 can be integrally molded, thereby permitting rapid and economic production of the tray sections.

A card rack which fulfills the previously-stated objects has now been disclosed in detail, and even though the invention has been described with reference to particular embodiments thereof, it will nonetheless be understood that still other embodiments will become apparent that are within the spirit and scope of the invention defined in the following claims.

What is claimed and desired to secure by Letters Patent is:

1. A card rack comprising:

a. a first tray section with elongated, spaced dividers that separate compartments therein, b. a second tray section having a downwardly projecting flap attached along an edge thereof, said flap having a plurality of slots at spaced intervals along its length, the spacing of said intervals corresponding to that of said dividers in the first tray section, and c. wherein said flap is emplaced inside said first tray with said dividers inserted into said slots of the flap.

2. Apparatus as in claim 1 and further comprising interlocking means for preventing inadvertent disengagement of said dividers from said slots of the flap.

3. A card rack as in claim 1 wherein said flap has a lower edge from which said slots lead substantially vertically and the lengthwise extension of said dividers is oriented substantially perpendicular to the lengthwise extension of said flap.

4. A card rack as in claim 3 wherein said first tray section has an upstanding edge member interconnected perpendicularly with said dividers and against which said flap is abutted when emplaced in said first tray.

5. A card rack as in claim 4 wherein said dividers comprise laterally projecting lugs at the locus of interconnection with said upstanding edge, and said slots of the flap comprise substantially horizontal deviations toward their upper ends which receive said lugs when said flap is emplaced in the first tray section.

6. A card rack as in claim 5 wherein said flap comprises tab sections adjacent said slots, said tabs being positioned beneath said lugs on the dividers when said flap is emplaced in said first tray.

7. A card rack as in claim 6 wherein said flap and the tab sections thereof are resilient and laterally deformable for passage of said tab sections past said lugs during emplacement of said flap in said first tray.

8. A card rack as in claim 4 wherein said first tray section comprises other dividers which transversally intersect said dividers that are oriented substantially perpendicular with respect to said flap.

9. A card rack as in claim 8 wherein said second tray further comprises transversally intersecting dividers.

10. A card rack as in claim 9 wherein said component parts of each of said tray sections are integrally molded from a flexible, resilient plastic material.

11. A card rack as in claim 10 wherein each of said tray sections further includes a bottom and outer edge member as integrally-molded component parts thereof.

* * * * *